US008062993B2

(12) United States Patent
Suga et al.

(10) Patent No.: US 8,062,993 B2
(45) Date of Patent: Nov. 22, 2011

(54) DEVELOPER MIXTURE FOR THERMAL RECORDING MATERIALS AND THERMAL RECORDING MATERIALS

(75) Inventors: Mamoru Suga, Osaka (JP); Nanako Okamoto, Fukuoka (JP); Aya Kato, Tokyo (JP); Takashi Date, Tokyo (JP); Yoshihide Kimura, Tokyo (JP)

(73) Assignees: API Corporation, Osaka (JP); Nippon Paper Industries Co., Ltd., Tokyo (JP)

( * ) Notice: Subject to any disclaimer, the term of this patent is extended or adjusted under 35 U.S.C. 154(b) by 245 days.

(21) Appl. No.: 10/592,430

(22) PCT Filed: Mar. 11, 2005

(86) PCT No.: PCT/JP2005/004846

§ 371 (c)(1),
(2), (4) Date: Nov. 8, 2006

(87) PCT Pub. No.: WO2005/087503

PCT Pub. Date: Sep. 22, 2005

(65) Prior Publication Data

US 2007/0173407 A1 Jul. 26, 2007

(30) Foreign Application Priority Data

Mar. 11, 2004 (JP) ..... 2004-069771

(51) Int. Cl.
*B41M 5/333* (2006.01)
*B41M 5/337* (2006.01)

(52) U.S. Cl. ..... 503/209; 503/216; 503/225

(58) Field of Classification Search ..... None
See application file for complete search history.

(56) References Cited

U.S. PATENT DOCUMENTS

| | | | | |
|---|---|---|---|---|
| 3,244,549 | A | 4/1966 | Farnham et al. | |
| 3,539,375 | A | 11/1970 | Baum | |
| 3,937,864 | A | 2/1976 | Kohmura et al. | |
| 2004/0241598 | A1* | 12/2004 | Suga et al. | 430/434 |
| 2005/0118526 | A1* | 6/2005 | Suga et al. | 430/224 |

FOREIGN PATENT DOCUMENTS

| | | |
|---|---|---|
| JP | 40-9309 | 5/1940 |
| JP | 43-4160 | 2/1968 |
| JP | 45-14039 | 5/1970 |
| JP | 49-45747 | 5/1974 |
| JP | 51-29830 | 8/1976 |
| JP | 56-144193 | 11/1981 |
| JP | 58-90984 | 5/1983 |
| JP | 58-181686 | 10/1983 |
| JP | 9-278695 | 10/1997 |
| JP | 2000-25344 | 1/2000 |
| JP | 2001-96926 | 4/2001 |
| JP | 2002-326463 | 11/2002 |
| JP | 2002-326464 | 11/2002 |
| JP | 2003-94830 | 4/2003 |
| JP | 2003-94831 | 4/2003 |
| JP | 2003-94836 | 4/2003 |
| JP | 2003-154760 | 5/2003 |
| JP | 2003-154761 | 5/2003 |
| WO | 02/098674 | 12/2002 |
| WO | 03/029017 | 4/2003 |

* cited by examiner

*Primary Examiner* — Bruce H Hess
(74) *Attorney, Agent, or Firm* — Wenderoth, Lind & Ponack, L.L.P.

(57) ABSTRACT

The present invention relates to a developer mixture for a thermal recording material, which comprises a mixture of the first organic developer comprising a condensate or a condensed composition represented by the formula (I):

(I)

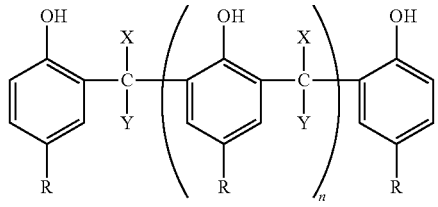

wherein R is a lower alkyl group or an aralkyl group, n is an integer of 0 to 5, and X and Y are each a hydrogen atom, an alkyl group or an aryl group, and the second organic developer other than the first organic developer (except 2,2-bis(3-methyl-4-hydroxyphenyl)propane), a developer mixture for a thermal recording material, and a thermal recording material having a heat-coloring layer containing the developer mixture. Using the developer mixture for a thermal recording material of the present invention, a thermal recording material sufficiently satisfying the recent requirement for high sensitivity, and having superior preservation stability of color images and non-image areas can be realized.

5 Claims, No Drawings

DEVELOPER MIXTURE FOR THERMAL RECORDING MATERIALS AND THERMAL RECORDING MATERIALS

TECHNICAL FIELD

The present invention relates to a developer mixture for thermal recording material and a thermal recording material. More particularly, the present invention relates to a developer mixture for thermal recording material, which shows a superior effect for the improvement of the sensitivity and image stability (i.e., preservation stability of color image and non-image areas) of a thermal recording material, and a highly sensitive thermal recording material superior in the image stability (preservation stability of color images and non-image areas).

BACKGROUND ART

In general, a thermal recording material (thermal recording medium) is obtained by pulverizing and dispersing a basic dye which is colorless or pale at ambient temperature and an organic developer as ultrafine particles, mixing them, mixing them with a binder, a filler, a sensitizer, a lubricant, other additive and the like, applying the resulting coating solution to a support such as paper, film plastic and the like, and drying to form a heat-coloring layer, wherein the heat-coloring layer of the thermal recording material is heated with a thermal head, a thermal pen, a laser beam and the like to afford developed color records. The basic principle of this recording method is considered to be based on the chemical contact of an electron donative dye and the organic developer in the heat-coloring layer, which changes the dye to a chromoplast. Since this recording method (i.e., thermal recording method) is characterized in that it does not require complicated treatments such as development, fixing and the like, as compared to other recording techniques (recording methods) now in practice, recording can be done in a short time at a comparatively low cost with a simple recording apparatus (recording means), maintenance is not necessary, noise does not occur during recording, and the obtained color is highly clear, it has been widely used as a recording method for printers for computer output, calculator and the like, recorder for medical measurement, facsimile, automatic ticket machine, labeling field, copying machine and the like. In recent years, however, the required quality of thermal recording materials (thermal recording media) is becoming higher as versatile and high performance apparatuses of those mentioned above have been developed and, for example, since the thermal energy of thermal heads of recording apparatuses tends to become very small as high speed recording and miniaturization of apparatuses proceeds, thermal recording materials (thermal recording media) are requested to have sensitivity enabling formation of high density and clear color image even with a small thermal energy.

As developer to be contained in the heat-coloring layer of thermal recording materials, various compounds having a phenolic hydroxyl group have been conventionally proposed (e.g., JP-B-40-9309, JP-B-43-4160, JP-B-45-14039, JP-B-51-29830, JP-A-56-144193 etc.). Of these, bisphenol compound, 4-hydroxybenzoate and the like have been practically used alone or in combination of several kinds thereof. However, thermal recording materials formed using such conventionally proposed developers have many problems of, for example, low heat response, insufficient color density obtained by high speed recording, uneven colors, time course changes in color image density after recording, discoloration during preservation, degraded heat-stable color of non-image areas, white powdery surface precipitation (so-called blooming), low reprintability and the like.

Hence, JP-A-9-278695, JP-A-2001-96926 and the like recently disclose methods using trisphenol compounds as developer or color degradation inhibitor. According to the study of the present inventors, however, addition of these compounds to the heat-coloring layer failed to afford sufficiently high color sensitivity. In addition, as developers, JP-A-58-181686 discloses a method comprising use of a 2,2'-methylenediphenol compound, WO02/098674 discloses a method comprising use of a condensate of a 2,2'-methylenedi-t-butylphenol compound and a condensed composition thereof, and WO03/029017 discloses a method comprising use of a condensate of a 2,2'-diphenol compound and a condensed composition thereof. However, use of the phenolic compounds described in these publications as developers failed to afford sufficiently high color sensitivity, and image stability such as heat resistance, moisture resistance, weatherability and the like was not sufficient. Moreover, JP-A-2003-154760 and JP-A-2003-154761 tried to improve image stability by a combined use of the aforementioned phenolic compounds (developer) with a stabilizer and a particular sensitizer, but these methods also failed to afford sufficient color sensitivity to meet the recent high-speed recordation and low energy consumption. As the situation stands, a thermal recording material sufficiently satisfying the recent requirement for high sensitivity as well as good image stability has not been obtained yet.

In view of the above-mentioned situation, the problem of the present invention is to provide a novel embodiment of a developer enabling to afford a thermal recording material sufficiently satisfying the recent requirement for high sensitivity, and good preservation stability of color image and non-image areas (particularly heat resistance and moisture resistance) and a thermal recording material using the developer, which has good preservation stability (particularly heat resistance and moisture resistance) of color images and non-image areas.

DISCLOSURE OF THE INVENTION

The present inventors have conducted intensive studies in an attempt to solve the above-mentioned problems and found that, when a mixture of an organic developer comprising a condensate or condensed composition represented by the following formula (I) and other known organic developer such as a bisphenol sulfone compound, a hydroxybenzoic acid derivative, a bisphenol and the like is used in combination with a basic dye, which is colorless or pale at ambient temperature to form a heat-coloring layer, color sensitivity of the thermal recording material markedly increases, and a superior effect on the preservation stability (particularly preservation stability of color image) of the thermal recording material after color can be afforded, which resulted in the completion of the present invention.

(I)

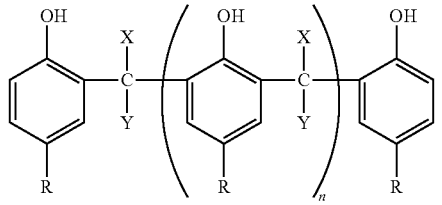

wherein R is a lower alkyl group or an aralkyl group, n is an integer of 0 to 5, and X and Y are each a hydrogen atom, an alkyl group or an aryl group.

Accordingly, the present invention relates to (1) a developer mixture for a thermal recording material, which comprises a mixture of the first organic developer comprising a condensate or a condensed composition represented by the formula (I):

(I)

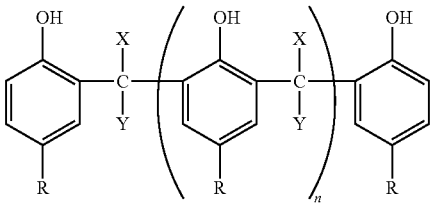

wherein R is a lower alkyl group or an aralkyl group, n is an integer of 0 to 5, and X and Y are each a hydrogen atom, an alkyl group or an aryl group, and the second organic developer other than the first organic developer (except 2,2-bis(3-methyl-4-hydroxyphenyl)propane), (2) the developer mixture for thermal recording material of the above-mentioned (1), wherein the first organic developer is a condensed composition mainly comprising a condensate of the formula (I) wherein n=0 (2 core condensate), and further comprising at least one kind of condensate selected from condensates of the formula (I) wherein n=1-5 (3-7 core condensates), (3) the developer mixture for thermal recording material of the above-mentioned (2), wherein the content of the condensate of the formula (I) wherein n=0 (2 core condensate) in the condensed composition, which is the first organic developer, is not less than 40%, (4) the developer mixture for thermal recording material of any one of the above-mentioned (1)-(3), wherein, in the formula (I), each R is a tert-butyl group, and X and Y are hydrogen atoms, (5) the developer mixture for thermal recording material of any one of the above-mentioned (1)-(4), wherein the second organic developer is at least one kind of organic developer selected from the group consisting of 4-hydroxy-4'-isopropoxydiphenylsulfone; 4-hydroxy-4'-propoxydiphenylsulfone; benzyl p-hydroxybenzoate; a composition comprising bis(3-allyl-4-hydroxyphenyl)sulfone and 2,2'-bis[4-(4-hydroxyphenylsulfone)phenoxy]diphenylether; 2,4-bisphenolsulfone and 4,4-bisphenolsulfone, (6) the developer mixture for thermal recording material of any one of the above-mentioned (1)-(5), which is obtained by dissolution mixing or melt mixing the first and the second organic developers, (7) the developer mixture for thermal recording material of any one of the above-mentioned (1)-(6), wherein the first and the second organic developers are mixed at a mixing ratio (the first organic developer:the second organic developer) of 99.9:0.1-50:50 (weight ratio), (8) the developer mixture for thermal recording material of any one of the above-mentioned (1)-(7), which is contained in a heat-coloring layer of a thermal recording material together with a colorless or pale basic dye, (9) a thermal recording material comprising a support and a heat-coloring layer formed thereon, which layer comprising a colorless or pale basic dye and the developer mixture of any one of the above-mentioned (1)-(7) as main components, and

(10) the thermal recording material of the above-mentioned (9), wherein the content of an organic developer in the heat-coloring layer is 1-8 parts by weight per 1 part by weight of the basic dye.

As described in the aforementioned Background Art, methods comprising use of two or more kinds of sensitizer or addition of a stabilizer so as to improve the color sensitivity and preservation stability of a thermal recording material have been known. However, the sensitivity-improving effect by these methods has not reached a level capable of sufficiently satisfying the high sensitivity requirements of recent years. In addition, it has been conventionally known that a combined use of two or more kinds of developers results in markedly degraded image stability as evidenced by color of non-image areas and the like.

According to the present invention, use of a mixture of an organic developer comprising a condensate or a condensed composition represented by the aforementioned formula (I) and other known organic developer markedly improves the color sensitivity of a thermal recording material (i.e., high density and clear color image even with a small thermal energy), and use of two or more kinds of developers in combination still affords good image stability. While such action and effect can be expressed by the use of a developer mixture obtained by powder mixing, dissolution mixing or melt mixing of an organic developer comprising a condensate or a condensed composition represented by the aforementioned formula (I) and other organic developer or by mixing of respective developer dispersions, they are remarkably expressed when the developer mixture is a molten mixture or a dissolution mixture.

The present invention is described in more detail in the following.

The developer mixture for thermal recording material of the present invention is a mixture of the first organic developer comprising a condensate or a condensed composition represented by the aforementioned formula (I), and the second organic developer other than the first organic developer.

In the present invention, "a condensate or a condensed composition represented by the formula (I)", which is the first organic developer, is a condensate of the formula (I) wherein n is 0, 1, 2, 3, 4 or 5, or a composition comprising at least two kinds of such 6 kinds of condensates.

In the formula (I), R is a lower alkyl group or an aralkyl group. As the lower alkyl group, an alkyl group having 1 to 5 carbon atoms (methyl, ethyl, propyl, isopropyl, n-butyl, sec-butyl, t-butyl, t-amyl etc.) is preferable, particularly preferably an alkyl group having 1 to 4 carbon atoms (e.g., methyl, isopropyl, t-butyl etc.) and most preferably a t-butyl group. As the aralkyl group, cumyl, α-methylbenzyl and the like are preferable, and a cumyl group is particularly preferable. X and Y are each a hydrogen atom, an alkyl group or an aryl group, and as the alkyl group, lower alkyl groups (methyl, ethyl, propyl, isopropyl, n-butyl, t-butyl, t-amyl and the like, carbon number 1-5) are preferable, and as the aryl group, phenyl, tolyl, naphthyl and the like are preferable. X and Y are particularly preferably hydrogen atoms.

Of the condensates represented by the formula (I), specific examples of a condensate wherein n=0 (2 core condensate) include 2,2'-methylenebis(4-methylphenol), 2,2'-methylenebis(4-ethylphenol), 2,2'-methylenebis(4-propylphenol), 2,2'-methylenebis(4-isopropylphenol), 2,2'-methylenebis(4-t-butylphenol), 2,2'-methylenebis(4-t-amylphenol), 2,2'-methylenebis(4-cumylphenol), 2,2'-methylenebis[4-(α-methylbenzyl)phenol], 2,2'-ethylidenebis(4-methylphenol), 2,2'-ethylidenebis(4-ethylphenol), 2,2'-ethylidenebis(4-propylphenol), 2,2'-ethylidenebis(4-isopropylphenol), 2,2'- ethylidenebis(4-t-butylphenol), 2,2'-ethylidenebis(4-t-amylphenol), 2,2'-ethylidenebis(4-cumylphenol), 2,2'-ethylidenebis[4-(α-methylbenzyl)phenol], 2'-(phenylmethylene)bis(4-methylphenol), 2,2'-(phenylmethylene)bis(4-ethylphenol), 2,2'-(phenylmethylene)bis(4-propylphenol), 2,2'-(phenylmethylene)bis(4-isopropylphenol), 2,2'-(phenylmethylene)bis(4-t-butylphenol), 2,2'-(phenylmethylene)bis(4-t-amylphenol), 2,2'-(phenylmethylene)bis(4-cumylphenol), 2,2'-(phenylmethylene)bis[4-(α-methylbenzyl)phenol] and the like. Of these, 2,2'-methylenebis(4-methylphenol), 2,2'-methylenebis(4-ethylphenol), 2,2'-methylenebis(4-isopropylphenol), 2,2'-methylenebis(4-t-butylphenol) and 2,2'-methylenebis(4-cumylphenol) are preferable, 2,2'-methylenebis(4-t-butylphenol) and 2,2'-methylenebis(4-cumylphenol) are particularly preferable and 2,2'-methylenebis(4-t-butylphenol) is most preferable.

Specific examples of a condensate wherein n=1 (3 core condensate) include 2,6-bis(2-hydroxy-5-methylbenzyl)-4-methylphenol, 2,6-bis(2-hydroxy-5-ethylbenzyl)-4-ethylphenol, 2,6-bis(2-hydroxy-5-propylbenzyl)-4-propylphenol, 2,6-bis(2-hydroxy-5-isopropylbenzyl)-4-isopropylphenol, 2,6-bis(2-hydroxy-5-t-butylbenzyl)-4-t-butylphenol, 2,6-bis(2-hydroxy-5-t-amylbenzyl)-4-t-amylphenol, 2,6-bis(2-hydroxy-5-cumylbenzyl)-4-cumylphenol, 2,6-bis[2-hydroxy-5-α-methylbenzyl)]-4-(α-methylbenzyl)phenol, 2,6-bis[1-(2-hydroxy-5-methylphenyl)ethyl]-4-methylphenol, 2,6-bis[1-(2-hydroxy-5-ethylphenyl)ethyl]-4-ethylphenol, 2,6-bis[1-(2-hydroxy-5-propylphenyl)ethyl]-4-propylphenol, 2,6-bis[1-(2-hydroxy-5-isopropylphenyl)ethyl]-4-isopropylphenol, 2,6-bis[1-(2-hydroxy-5-t-butylphenyl)ethyl]-4-t-butylphenol, 2,6-bis[1-(2-hydroxy-5-t-amylphenyl)ethyl]-4-t-amylphenol, 2,6-bis[1-(2-hydroxy-5-cumylphenyl)ethyl]-4-cumylphenol, 2,6-bis[1-[2-hydroxy-5-[(α-methylbenzyl)phenyl]ethyl]-4-α-methylbenzyl)phenol, 2,6-bis[α-(2-hydroxy-5-methylphenyl)benzyl]-4-methylphenol, 2,6-bis[α-(2-hydroxy-5-ethylphenyl)benzyl]-4-ethylphenol, 2,6-bis[α-(2-hydroxy-5-propylphenyl)benzyl]-4-propylphenol, 2,6-bis[α-(2-hydroxy-5-isopropylphenyl)benzyl]-4-isopropylphenol, 2,6-bis[α-(2-hydroxy-5-t-butylphenyl)benzyl]-4-t-butylphenol, 2,6-bis[α-(2-hydroxy-5-t-amylphenyl)benzyl]-4-t-amylphenol, 2,6-bis[α-(2-hydroxy-5-cumylphenyl)benzyl]-4-cumylphenol, and 2,6-bis[α-[2-hydroxy-5-(α-methylbenzyl)phenyl]benzyl]-4-α-methylbenzyl)phenol. Of these, 2,6-bis(2-hydroxy-5-methylbenzyl)-4-methylphenol, 2,6-bis(2-hydroxy-5-ethylbenzyl)-4-ethylphenol, 2,6-bis(2-hydroxy-5-isopropylbenzyl)-4-isopropylphenol, 2,6-bis(2-hydroxy-5-t-butylbenzyl)-4-t-butylphenol and 2,6-bis(2-hydroxy-5-cumylbenzyl)-4-cumylphenol are preferable, 2,6-bis(2-hydroxy-5-t-butylbenzyl)-4-t-butylphenol and 2,6-bis(2-hydroxy-5-cumylbenzyl)-4-cumylphenol are particularly preferable, and 2,6-bis(2-hydroxy-5-t-butylbenzyl)-4-t-butylphenol is most preferable.

Specific examples of a condensate wherein n=2 (4 core condensate) include 2,2'-methylenebis[6-[(2-hydroxy-5-methylphenyl)methyl]-4-methylphenol],
2,2'-methylenebis[6-[(2-hydroxy-5-ethylphenyl)methyl]-4-ethylphenol],
2,2'-methylenebis[6-[(2-hydroxy-5-propylphenyl)methyl]-4-propylphenol],
2,2'-methylenebis[6-[(2-hydroxy-5-isopropylphenyl)methyl]-4-isopropylphenol],
2,2'-methylenebis[6-[(2-hydroxy-5-t-butylphenyl)methyl]-4-t-butylphenol],
2,2"-methylenebis[6-[(2-hydroxy-5-t-amylphenyl)methyl]-4-t-amylphenol],
2,2'-methylenebis[6-[(2-hydroxy-5-cumylphenyl)methyl]-4-cumylphenol],
2,2'-methylenebis[6-[(2-hydroxy-5-α-methylbenzyl)phenyl)methyl]-4-(α-methylbenzyl)phenol],
2,2'-ethylidenebis[6-[1-(2-hydroxy-5-methylphenyl)ethyl]-4-methylphenol],
2,2'-ethylidenebis[6-[1-(2-hydroxy-5-ethylphenyl)ethyl]-4-ethylphenol],
2,2'-ethylidenebis[6-[1-(2-hydroxy-5-propylphenyl)ethyl]-4-propylphenol],
2,2'-ethylidenebis[6-[1-(2-hydroxy-5-isopropylphenyl)ethyl]-4-isopropylphenol],
2,2'-ethylidenebis[6-[1-(2-hydroxy-5-t-butylphenyl)ethyl]-4-t-butylphenol],
2,2'-ethylidenebis[6-[1-(2-hydroxy-5-t-amylphenyl)ethyl]-4-t-amylphenol],
2,2'-ethylidenebis[6-[1-(2-hydroxy-5-cumylphenyl)ethyl]-4-cumylphenol],
2,2'-ethylidenebis[6-[1-(2-hydroxy-5-α-methylphenyl)ethyl]-4-α-methylphenol],
2,2'-(phenylmethylene)bis[6-[α-(2-hydroxy-5-methylphenyl)benzyl]-4-methylphenol],
2,2'-(phenylmethylene)bis[6-[α-(2-hydroxy-5-ethylphenyl)benzyl]-4-ethylphenol],
2,2'-(phenylmethylene)bis[6-[α-(2-hydroxy-5-propylphenyl)benzyl]-4-propylphenol],
2,2'-(phenylmethylene)bis[6-[α-(2-hydroxy-5-isopropylphenyl)benzyl]-4-isopropylphenol],
2,2'-(phenylmethylene)bis[6-[α-(2-hydroxy-5-t-butylphenyl)benzyl]-4-t-butylphenol],
2,2'-(phenylmethylene)bis[6-[α-(2-hydroxy-5-t-amylphenyl)benzyl]-4-t-amylphenol],
2,2'-(phenylmethylene)bis[6-[α-(2-hydroxy-5-cumylphenyl)benzyl]-4-cumylphenol], and
2,2'-(phenylmethylene)bis[6-[α-[2-hydroxy-5-α-methylbenzyl)phenyl]benzyl]-4-(α-methylbenzyl)phenol].

Specific examples of a condensate wherein n=3 (5 core condensate) include 2,6-bis[[2-hydroxy-3-[(2-hydroxy-5-methylphenyl)methyl]-5-methylphenyl]methyl]-4-methylphenol,
2,6-bis[[2-hydroxy-3-[(2-hydroxy-5-ethylphenyl)methyl]-5-ethylphenyl]methyl]-4-ethylphenol,
2,6-bis[[2-hydroxy-3-[(2-hydroxy-5-propylphenyl)methyl]-5-propylphenyl]methyl]-4-propylphenol,
2,6-bis[[2-hydroxy-3-[(2-hydroxy-5-isopropylphenyl)methyl]-5-isopropylphenyl]methyl]-4-isopropylphenol,
2,6-bis[[2-hydroxy-3-[(2-hydroxy-5-t-butylphenyl)methyl]-5-t-butylphenyl]methyl]-4-t-butylphenol,
2,6-bis[[2-hydroxy-3-[(2-hydroxy-5-t-amylphenyl)methyl]-5-t-amylphenyl]methyl]-4-t-amylphenol,
2,6-bis[[2-hydroxy-3-[(2-hydroxy-5-cumylphenyl)methyl]-5-cumylphenyl]methyl]-4-cumylphenol,
[[2-hydroxy-3-[(2-hydroxy-5-(α-methylbenzyl)phenyl)methyl]-5-(α-methylbenzyl)phenyl]methyl]-4-(α-methylbenzyl)phenol,
2,6-bis[1-[2-hydroxy-3-[1-(2-hydroxy-5-methylphenyl)ethyl]-5-methylphenyl]ethyl]-4-methylphenol,
2,6-bis[1-[2-hydroxy-3-[1-(2-hydroxy-5-ethylphenyl)ethyl]-5-ethylphenyl]ethyl]-4-ethylphenol,
2,6-bis[1-[2-hydroxy-3-[1-(2-hydroxy-5-propylphenyl)ethyl]-5-propylphenyl]ethyl]-4-propylphenol,
2,6-bis[1-[2-hydroxy-3-[1-(2-hydroxy-5-isopropylphenyl)ethyl]-5-isopropylphenyl]ethyl]-4-isopropylphenol,
2,6-bis[1-[2-hydroxy-3-[1-(2-hydroxy-5-t-butylphenyl)ethyl]-5-t-butylphenyl]ethyl]-4-t-butylphenol, 2,6-bis[1-[2-hydroxy-3-[1-(2-hydroxy-5-t-amylphenyl) ethyl]-5-t-amylphenyl]ethyl]-4-t-amylphenol, 2,6-bis[1-[2-hydroxy-3-[1-(2-hydroxy-5-cumylphenyl) ethyl]-5-cumylphenyl]ethyl]-4-cumylphenol, 2,6-bis[1-[2-hydroxy-3-[1-[2-hydroxy-5-α-methylbenzyl) phenyl]ethyl]-5-(α-methylbenzyl)phenyl]ethyl]-4-(α-methylbenzyl)phenol, 2,6-bis[α-[2-hydroxy-3-[α-(2-hydroxy-5-methylphenyl) benzyl]-5-methylphenyl]benzyl]-4-methylphenol, 2,6-bis[α-[2-hydroxy-3-[α-(2-hydroxy-5-ethylphenyl)benzyl]-5-ethylphenyl]benzyl]-4-ethylphenol, 2,6-bis[α-[2-hydroxy-3-[α-(2-hydroxy-5-propylphenyl) benzyl]-5-propylphenyl]benzyl]-4-propylphenol, 2,6-bis[α-[2-hydroxy-3-[α-(2-hydroxy-5-isopropylphenyl) benzyl]-5-isopropylphenyl]benzyl]-4-isopropylphenol, 2,6-bis[α-[2-hydroxy-3-[α-(2-hydroxy-5-t-butylphenyl) benzyl]-5-t-butylphenyl]benzyl]-4-t-butylphenol, 2,6-bis[α-[2-hydroxy-3-[α-(2-hydroxy-5-t-amylphenyl) benzyl]-5-t-amylphenyl]benzyl]-4-t-amylphenol, 2,6-bis[α-[2-hydroxy-3-[α-(2-hydroxy-5-cumylphenyl)benzyl]-5-cumylphenyl]benzyl]-4-cumylphenol, 2,6-bis[α-[2-hydroxy-3-[α-[2-hydroxy-5-(α-methylbenzyl) phenyl]benzyl]-5-(α-methylbenzyl)phenyl]benzyl]-4-(α-methylbenzyl)phenol and the like.

Specific examples of a condensate wherein n=4 (6 core condensate) include 2,2'-methylenebis[6-[[2-hydroxy-[3-(2-hydroxy-5-methylphenyl)methyl]-5-methylphenyl]methyl]-4-methylphenol], 2,2'-methylenebis[6-[[2-hydroxy-[3-(2-hydroxy-5-ethyl phenyl)methyl]-5-ethylphenyl]methyl]-4-ethylphenol], 2,2'-methylenebis[6-[[2-hydroxy-3-[(2-hydroxy-5-propylphenyl)methyl]-5-propylphenyl]methyl]-4-propylphenol], 2,2'-methylenebis[6-[[2-hydroxy-3-[(2-hydroxy-5-isopropylphenyl)methyl]-5-isopropylphenyl]methyl]-4-isopropylphenol], 2,2'-methylenebis[6-[[2-hydroxy-3-[(2-hydroxy-5-t-butylphenyl)methyl]-5-t-butylphenyl]methyl]-4-t-butylphenol], 2,2'-methylenebis[6-[[2-hydroxy-3-[(2-hydroxy-5-t-amylphenyl)methyl]-5-t-amylphenyl]methyl]-4-t-amylphenol], 2,2'-methylenebis[6-[[2-hydroxy-3-[(2-hydroxy-5-cumylphenyl)methyl]-5-cumylphenyl]methyl]-4-cumylphenol], 2,2'-methylenebis[6-[[2-hydroxy-3-[(2-hydroxy-5-α-methylbenzyl)phenyl)methyl]-5-(α-methylbenzyl)phenyl]methyl]-4-(α-methylbenzyl)phenol], 2,2'-ethylidenebis[6-[1-[2-hydroxy-3-[1-(2-hydroxy-5-methylphenyl)ethyl]-5-methylphenyl]ethyl]-4-methylphenol], 2,2'-ethylidenebis[6-[1-[2-hydroxy-3-[1-(2-hydroxy-5-ethylphenyl)ethyl]-5-ethylphenyl]ethyl]-4-ethylphenol], 2,2'-ethylidenebis[6-[1-[2-hydroxy-3-[1-(2-hydroxy-5-propylphenyl)ethyl]-5-propylphenyl]ethyl]-4-propylphenol], 2,2'-ethylidenebis[6-[1-[2-hydroxy-3-[1-(2-hydroxy-5-isopropylphenyl)ethyl]-5-isopropylphenyl]ethyl]-4-isopropylphenol], 2,2'-ethylidenebis[6-[1-[2-hydroxy-3-[1-(2-hydroxy-5-t-butylphenyl)ethyl]-5-t-butylphenyl]ethyl]-4-t-butylphenol], 2,2'-ethylidenebis[6-[1-[2-hydroxy-3-[1-(2-hydroxy-5-t-amylphenyl)ethyl]-5-t-amylphenyl]ethyl]-4-t-amylphenol], 2,2'-ethylidenebis[6-[1-[2-hydroxy-3-[1-(2-hydroxy-5-cumylphenyl)ethyl]-5-cumylphenyl]ethyl]-4-cumylphenol], 2,2'-ethylidenebis[6-[1-[2-hydroxy-3-[1-(2-hydroxy-5-α-methylphenyl)ethyl]-5-α-methylphenyl]ethyl]-4-α-methylphenol], 2,2'-(phenylmethylene)bis[6-[α-[2-hydroxy-3-[α-(2-hydroxy-5-methylphenyl)benzyl]-5-methylphenyl]benzyl]-4-methylphenol], 2,2'-(phenylmethylene)bis[6-[α-[2-hydroxy-3-[α-(2-hydroxy-5-ethylphenyl)benzyl]-5-ethylphenyl]benzyl]-4-ethylphenol], 2,2'-(phenylmethylene)bis[6-[α-[2-hydroxy-3-[α-(2-hydroxy-5-propylphenyl)benzyl]-5-propylphenyl]benzyl]-4-propylphenol], 2,2'-(phenylmethylene)bis[6-[α-[2-hydroxy-3-[α-(2-hydroxy-5-isopropylphenyl)benzyl]-5-isopropylphenyl] benzyl]-4-isopropylphenol], 2,2'-(phenylmethylene)bis[6-[α-[2-hydroxy-3-[α-(2-hydroxy-5-t-butylphenyl)benzyl]-5-t-butylphenyl]benzyl]-4-t-butylphenol], 2,2'-(phenylmethylene)bis[6-[α-[2-hydroxy-3-[α-(2-hydroxy-5-t-amylphenyl)benzyl]-5-t-amylphenyl]benzyl]-4-t-amylphenol], 2,2'-(phenylmethylene)bis[6-[α-[2-hydroxy-3-[α-(2-hydroxy-5-cumylphenyl)benzyl]-5-cumylphenyl]benzyl]-4-cumylphenol], 2,2'-(phenylmethylene)bis[6-[α-[2-hydroxy-3-[α-[2-hydroxy-5-(α-methylbenzyl)phenyl]benzyl]-5-α-methylbenzyl)phenyl]benzyl]-4-(α-methylbenzyl)phenol].

Specific examples of a condensate wherein n=5 (7 core condensate) include 2,6-bis[[2-hydroxy-3-[[2-hydroxy-3-[(2-hydroxy-5-methylphenyl)methyl]-5-methylphenyl]methyl]-5-methylphenyl]methyl]-4-methylphenol, 2,6-bis[[2-hydroxy-3-[[2-hydroxy-3-[(2-hydroxy-5-ethylphenyl)methyl]-5-ethylphenyl]methyl]-5-ethylphenyl] methyl]-4-ethylphenol, 2,6-bis[[2-hydroxy-3-[[2-hydroxy-3-[(2-hydroxy-5-propylphenyl)methyl]-5-propylphenyl]methyl]-5-propylphenyl]methyl]-4-propylphenol, 2,6-bis[[2-hydroxy-3-[2-hydroxy-3-[(2-hydroxy-5-isopropylphenyl)methyl]-5-isopropylphenyl]methyl]-5-isopropylphenyl]methyl]-4-isopropylphenol, 2,6-bis[[2-hydroxy-3-[2-hydroxy-3-[(2-hydroxy-5-t-butylphenyl)methyl]-5-t-butylphenyl]methyl]-5-t-butylphenyl]methyl]-4-t-butylphenol, 2,6-bis[[2-hydroxy-3-[2-hydroxy-3-[(2-hydroxy-5-t-amylphenyl)methyl]-5-t-amylphenyl]methyl]-5-t-amylphenyl]methyl]-4-t-amylphenol, 2,6-bis[[2-hydroxy-3-[2-hydroxy-3-[(2-hydroxy-5-cumylphenyl)methyl]-5-cumylphenyl]methyl]-5-cumylphenyl]methyl]-4-cumylphenol, 2,6-bis[[2-hydroxy-3-[2-hydroxy-3-[(2-hydroxy-5-(α-methylbenzyl)phenyl)methyl]-5-(α-methylbenzyl)phenyl] methyl]-5-(α-methylbenzyl)phenyl]methyl]-4-(α-methylbenzyl)phenol, 2,6-bis[1-[2-hydroxy-3-[1-[2-hydroxy-3-[[1-(2-hydroxy-5-methylphenyl)ethyl]-5-methylphenyl]ethyl]-5-methylphenyl]ethyl]-4-methylphenol, 2,6-bis[1-[2-hydroxy-3-[1-[2-hydroxy-3-[[1-(2-hydroxy-5-ethylphenyl)ethyl]-5-ethylphenyl]ethyl]-5-ethylphenyl] ethyl]-4-ethylphenol, 2,6-bis[1-[2-hydroxy-3-[1-[2-hydroxy-3-[[1-(2-hydroxy-5-propylphenyl)ethyl]-5-propylphenyl]ethyl]-5-propylphenyl]ethyl]-4-propylphenol, 2,6-bis[1-[2-hydroxy-3-[1-[2-hydroxy-3-[[1-(2-hydroxy-5-isopropylphenyl)ethyl]-5-isopropylphenyl]ethyl]-5-isopropylphenyl]ethyl]-4-isopropylphenol, 2,6-bis[1-[2-hydroxy-3-[1-[2-hydroxy-3-[[1-(2-hydroxy-5-t-butylphenyl)ethyl]-5-t-butylphenyl]ethyl]-5-t-butylphenyl]ethyl]-4-t-butylphenol, 2,6-bis[1-[2-hydroxy-3-[1-[2-hydroxy-3-[1-(2-hydroxy-5-t-amylphenyl)ethyl]-5-t-amylphenyl]ethyl]-5-t-amylphenyl]ethyl]-4-t-amylphenol, 2,6-bis[1-[2-hydroxy-3-[1-[2-hydroxy-3-[[1-(2-hydroxy-5-cumylphenyl)ethyl]-5-cumylphenyl]ethyl]-5-cumylphenyl]ethyl]-4-cumylphenol, 2,6-bis[α-[2-hydroxy-3-[α-[2-hydroxy-3-[[α-(2-hydroxyphenyl)benzyl]phenyl]benzyl]phenyl]benzyl]phenol, 2,6-bis[α-[2-hydroxy-3-[α-[2-hydroxy-3-[[α-(2-hydroxy-5-methylphenyl)benzyl]-5-methylphenyl]benzyl]-5-methylphenyl]benzyl]-4-methylphenol, 2,6-bis[α-[2-hydroxy-3-[α-[2-hydroxy-3-[[α-(2-hydroxy-5-ethylphenyl)benzyl]-5-ethylphenyl]benzyl]-5-ethylphenyl]benzyl]-4-ethylphenol, 2,6-bis[α-[2-hydroxy-3-[α-[2-hydroxy-3-[[α-(2-hydroxy-5-propylphenyl)benzyl]-5-propylphenyl]benzyl]-5-propylphenyl]benzyl]-4-propylphenol, 2,6-bis[α-[2-hydroxy-3-[α-[2-hydroxy-3-[[α-(2-hydroxy-5-isopropylphenyl)benzyl]-5-isopropylphenyl]benzyl]-5-isopropylphenyl]benzyl]-4-isopropylphenol, 2,6-bis[α-[2-hydroxy-3-[α-[2-hydroxy-3-[[α-(2-hydroxy-5-t-butylphenyl)benzyl]-5-t-butylphenyl]benzyl]-5-t-butylphenyl]benzyl]-4-t-butylphenol, 2,6-bis[α-[2-hydroxy-3-[α-[2-hydroxy-3-[[α-(2-hydroxy-5-t-amylphenyl)benzyl]-5-t-amylphenyl]benzyl]-5-t-amylphenyl]benzyl]-4-t-amylphenol, 2,6-bis[α-[2-hydroxy-3-[α-[2-hydroxy-3-[[α-(2-hydroxy-5-cumylphenyl)benzyl]-5-cumylphenyl]benzyl]-5-cumylphenyl]benzyl]-4-cumylphenol, 2,6-bis[α-[2-hydroxy-3-[α-[2-hydroxy-3-[[α-[2-hydroxy-5-α-methylbenzyl)phenyl]benzyl]-5-(α-methylbenzyl)phenyl]benzyl]-5-(α-methylbenzyl)phenyl]benzyl]-4-(α-methylbenzyl)phenol and the like.

In the present invention, the "core" of the "2 core condensate, 3 core condensate, . . . 7 core condensate" of the condensates represented by the formula (I) is a phenol skeleton of a condensate represented by the formula (I), and 2 core, 3 core . . . 7 core each mean a condensate represented by the formula (I) wherein the number of the phenol skeleton (i.e., number of condensation of substituted phenols of starting materials) is 2, 3 . . . 7.

In the present invention, the first organic developer comprising a condensate or a condensed composition represented by the formula (I) is preferably a condensed composition represented by the formula (I). Particularly, a condensed composition mainly comprising a 2 core condensate of the formula wherein n=0 (i.e., a condensed composition mainly comprising a condensate of the formula (I) wherein n=0 (2 core condensate), and further comprising at least one kind of condensate selected from condensates of the formula (I) wherein n=1-5 (3-7 core condensates)) is preferable. Note that "mainly comprising a 2 core condensate of the formula wherein n=0" means that the proportion of the 2 core condensate of the formula (I) wherein n=0 in the composition is the highest.

As the condensed composition mainly comprising a 2 core condensate of the formula wherein n=0, a composition mainly comprising a 2 core condensate of the formula wherein n=0 and further comprising a 3 core condensate of the formula wherein n=1; a composition mainly comprising a 2 core condensate of the formula wherein n=0 and further comprising a 3 core condensate of the formula wherein n=1 and a 4 core condensate of the formula wherein n=2; a composition mainly comprising a 2 core condensate of the formula wherein n=0 and further comprising a 3 core condensate of the formula wherein n=1, a 4 core condensate of the formula wherein n=2 and a 5 core condensate of the formula wherein n=3; a composition mainly comprising a 2 core condensate of the formula wherein n=0 and further comprising a 3 core condensate of the formula wherein n=1, a 4 core condensate of the formula wherein n=2, a 5 core condensate of the formula wherein n=3 and a 6 core condensate of the formula wherein n=4; or a composition mainly comprising a 2 core condensate of the formula wherein n=0 and further comprising a 3 core condensate of the formula wherein n=1, a 4 core condensate of the formula wherein n=2, a 5 core condensate of the formula wherein n=3, a 6 core condensate of the formula wherein n=4 and a 7 core condensate of the formula wherein n=5 is preferable.

In the condensed composition mainly comprising a 2 core condensate of the formula wherein n=0, the content of the 2 core condensate is preferably not less than 40%, particularly preferably 50-90%, especially preferably 50-85% relative to the whole condensate. When the content of the 2 core condensate relative to the whole condensed composition is less than 40%, improvement of color sensitivity, preservation stability of color images and non-image areas of the object thermal recording material tends to be not sufficiently expressed. As used herein, "%" means "area %" in the results of the analysis by high performance liquid chromatography.

A particularly preferable example of the condensed composition mainly comprising a 2 core condensate of the formula wherein n=0 include, is a condensed composition mainly comprising the particularly preferable example compound (2 core condensate) from the above-mentioned specific examples of the 2 core condensate, and further comprising at least one condensate from the 3-7 core condensates corresponding to the compound (2 core condensate).

The condensate or condensed composition represented by the formula (I) can be produced by a known synthetic method comprising, for example, reacting substituted phenol represented by the following formula (III) with a ketone compound or a formaldehyde compound represented by the following formula (IV) in the presence of an acid catalyst (e.g., hydrochloric acid, p-toluenesulfonic acid and the like), and the like. The reaction is carried out in a suitable organic solvent inert to the reaction, which can dissolve the starting material and reaction product, such as water, methanol, ethanol, n-propyl alcohol, isopropyl alcohol, acetonitrile, toluene, chloroform, diethyl ether, N,N-dimethylacetamide, benzene, chlorobenzene, dichlorobenzene, tetrahydrofuran and the like, at a reaction temperature of 0-150° C. for several hours to several dozen hours. After the reaction, by removing unreacted substituted phenol by distillation, an object condensate or condensed composition (solid) can be obtained in a high yield. The thus-obtained object condensate or condensed composition may contain a condensate of the formula (I) wherein n is not less than 6 as an impurity. In addition, by recrystallizing the condensate or condensed composition obtained in this way in a suitable solvent, an object condensate or a condensed composition with a high purity can be also obtained. A condensed composition comprising condensates having different substituents (R, X, Y in the formula) can be obtained by mixing reaction products (condensates or condensed compositions) different from each other produced in advance using starting material compounds different from each other, or adding, to a reaction system for synthesizing a particular condensate or condensed composition, a condensate or condensed composition having a different substituent from the particular condensate or condensed composition produced in advance.

(III)

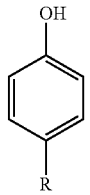

wherein R is as defined above.

(IV)

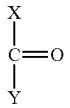

wherein X and Y are as defined above.

As R for substituted phenol in the formula (III), a lower alkyl group or an aralkyl group is preferable. R is preferably a t-butyl group or a cumyl group, particularly preferably a t-butyl group.

As specific examples of the substituted phenol represented by the formula (III), p-cresol, p-ethylphenol, p-propylphenol, p-isopropylphenol, p-t-butylphenol, p-t-amylphenol, p-cumylphenol, p-(α-methylbenzyl)phenol and the like can be mentioned. Of these, p-t-butylphenol and p-cumylphenol are preferable, and p-t-butylphenol is particularly preferable.

As specific examples of the ketone compound and aldehyde compound represented by the formula (IV), dimethylketone, diethylketone, ethylmethylketone, methylisobutylketone, formaldehyde, para-formaldehyde, butylaldehyde, benzaldehyde and the like can be mentioned.

As the second organic developer in the developer mixture of the present invention, for example, bisphenolsulfone compound; hydroxybenzoic acid derivative; bisphenols; 4-hydroxyphthalic acid diesters; phthalic acid monoesters; bis-(hydroxyphenyl)sulfides; 4-hydroxyphenylarylsulfones such as 4-(4-propoxy-benzenesulfonyl)-phenol, 4-(4-isopropoxy-benzenesulfonyl)-phenol and the like; 4-hydroxyphenylarylsulfonates; 1,3-di[2-(hydroxyphenyl)-2-propyl]-benzenes; 1,1-bis(p-hydroxyphenyl)propane and the like can be mentioned. Of these, 4-hydroxy-4'-isopropoxydiphenylsulfone; 4-hydroxy-4'-propoxydiphenylsulfone; benzyl p-hydroxybenzoate (BZ); a composition containing bis(3-allyl-4-hydroxyphenyl)sulfone, and 2,2'-bis[4-(4-hydroxyphenylsulfone)phenoxy]diphenylether (manufactured by NIPPON SODA CO., LTD., D-90 (product name)); 2,4-bisphenolsulfone; and 4,4-bisphenolsulfone are particularly preferable, 4-hydroxy-4'-isopropoxydiphenylsulfone; 4-hydroxy-4'-propoxydiphenylsulfone; a composition containing bis-(3-allyl-4-hydroxyphenyl)sulfone, and 2,2'-bis[4-(4-hydroxyphenylsulfone)phenoxy]diphenylether (manufactured by NIPPON SODA CO., LTD., D-90) are especially preferable.

The developer mixture of the present invention is a mixture of the aforementioned first organic developer and the second organic developer. As the form of the mixture, a powder mixture obtained by mixing the first organic developer (powder) and the second organic developer (powder), a dissolution mixture obtained by dissolving and mixing the first organic developer and the second organic developer, a molten mixture obtained by melt mixing the first organic developer and the second organic developer, and a mixed dispersion wherein the first organic developer dispersion and the second organic developer dispersion are mixed can be mentioned. Of these, a dissolution mixture or a molten mixture is preferable, since the use of a dissolution mixture or molten mixture enables more remarkable expression of the improvement effect on the color sensitivity and preservation stability of the object thermal recording material.

The dissolution mixture refers to a solid product obtained by drying a solution in which the first organic developer and the second organic developer have been dissolved, which can be obtained, for example, by adding the second organic developer to a reaction solution, from which a condensate or a condensed composition represented by the formula (I) (the first organic developer) has been synthesized (i.e., a reaction solution obtained by reacting the substituted phenol represented by the aforementioned formula (II) with the ketone represented by the aforementioned formula (III)), removing unreacted substituted phenol by distillation, and recovering a solid from the reaction solution. According to this method, a dissolution mixture of the first organic developer and the second organic developer can be efficiency obtained.

The molten mixture refers to a solid product obtained by mixing the first organic developer and the second organic developer at a temperature not lower than the melting points of the both (melt mixing), and cooling the mixture, which can be obtained, for example, by mixing the first organic developer and the second organic developer in a powder state, heating the mixture at a temperature not lower than the melting points of the both to allow melt-mixing, and forcibly cooling the obtained molten product by allowing to cool, rapidly cooling to approximately room temperature and the like, to allow solidification.

The mixing ratio (weight ratio) of the first organic developer and the second organic developer in the developer mixture of the present invention is preferably 99.9:0.1-50:50, more preferably 99.9:0.1-70:30, particularly preferably 99:1-90:10, especially preferably 99:1-95:5. When the amount of the second organic developer is smaller than such ranges (the amount of the first organic developer is high), an improvement effect on the color sensitivity, preservation stability of the object thermal recording material tends to be not sufficiently afforded. On the other hand, when the amount of the second organic developer is high (the amount of the first organic developer is small), coloring of the non-image areas due to heat and humidity may intensify.

The thermal recording material of the present invention is made of, as a developer, a developer mixture of the present invention, which is a mixture of the first organic developer and the second organic developer explained above. That is, the thermal recording material of the present invention is characteristically a thermal recording material comprising a support and a heat-coloring layer formed on the support, which contains a colorless or pale basic dye and an organic developer as main components, wherein the heat-coloring layer comprises two kinds or more of organic developers, and one kind of the organic developers is made of a condensate or a condensed composition represented by the aforementioned formula (I).

In the thermal recording material of the present invention, the content of the entire organic developer (developer mixture) in the heat-coloring layer is preferably about 0.5-10 parts by weight, more preferably 1-8 parts by weight, particularly preferably 2-5 parts by weight, per 1 part by weight of the basic dye. When the content of the entire organic developer (developer mixture) in the heat-coloring layer is less than 1 part by weight per 1 part by weight of the basic dye, the color sensitivity does not improve sufficiently, and when it exceeds 8 parts by weight, unpreferably, a remarkable effect cannot be observed.

In the thermal recording material of the present invention, the basic dye to be contained in the heat-coloring layer may be any colorless to pale basic dye known and used in the field of pressure sensitive or thermal recording paper material and is not particularly limited. Particularly, it is preferably a leucodye such as triphenylmethane, fluoran, fluorene, divinyl and the like. Specific examples of preferable basic dye are shown in the following. The basic dye may be used alone or in combination of two or more kinds thereof.

<Triphenylmethane Leucodye>

3,3-bis(p-dimethylaminophenyl)-6-dimethylaminophthalide, 3,3-bis(p-dimethylaminophenyl)phthalide, <fluoran Leucodye>

3-diethylamino-6-methylfluoran, 3-diethylamino-6-methyl-7-anilinofluoran, 3-diethylamino-6-methyl-7-(o,p-dimethylanilino)fluoran, 3-diethylamino-6-methyl-7-chlorofluoran, 3-diethylamino-6-methyl-7-(m-trifluoromethylanilino)fluoran, 3-diethylamino-6-methyl-7-(o-chloroanilino)fluoran, 3-diethylamino-6-methyl-7-(p-chloroanilino)fluoran, 3-diethylamino-6-methyl-7-(o-fluoroanilino)fluoran, 3-diethylamino-6-methyl-7-(m-methylanilino)fluoran, 3-diethylamino-6-methyl-7-n-octylanilinofluoran, 3-diethylamino-6-methyl-7-n-octylaminofluoran, 3-diethylamino-6-methyl-7-benzylanilinofluoran, 3-diethylamino-6-methyl-7-dibenzylanilinofluoran, 3-diethylamino-6-chloro-7-methylfluoran, 3-diethylamino-6-chloro-7-anilinofluoran, 3-diethylamino-6-chloro-7-p-methylanilinofluoran, 3-diethylamino-6-ethoxyethyl-7-anilinofluoran, 3-diethylamino-7-methylfluoran, 3-diethylamino-7-chlorofluoran, 3-diethylamino-7-(m-trifluoromethylanilino)fluoran, 3-diethylamino-7-(o-chloroanilino)fluoran, 3-diethylamino-7-(p-chloroanilino)fluoran, 3-diethylamino-7-(o-fluoroanilino)fluoran, 3-diethylamino-benzo[a]fluoran, 3-diethylamino-benzo[c]fluoran, 3-dibutylamino-6-methyl-fluoran, 3-dibutylamino-6-methyl-7-anilinofluoran, 3-dibutylamino-6-methyl-7-(o,p-dimethylanilino)fluoran, 3-dibutylamino-6-methyl-7-(o-chloroanilino)fluoran, 3-dibutylamino-6-methyl-7-(p-chloroanilino)fluoran, 3-dibutylamino-6-methyl-7-(o-fluoroanilino)fluoran, 3-dibutylamino-6-methyl-7-(m-trifluoromethylanilino)fluoran, 3-dibutylamino-6-methyl-chlorofluoran, 3-dibutylamino-6-ethoxyethyl-7-anilinofluoran, 3-dibutylamino-6-chloro-7-anilinofluoran, 3-dibutylamino-6-methyl-7-p-methylanilinofluoran, 3-dibutylamino-7-(o-chloroanilino)fluoran, 3-dibutylamino-7-(o-fluoroanilino)fluoran, 3-di-n-pentylamino-6-methyl-7-anilinofluoran, 3-di-n-pentylamino-6-methyl-7-(p-chloroanilino)fluoran, 3-di-n-pentylamino-7-(m-trifluoromethylanilino)fluoran, 3-di-n-pentylamino-6-chloro-7-anilinofluoran, 3-di-n-pentylamino-7-(p-chloroanilino)fluoran, 3-pyrrolidino-6-methyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-N-cyclohexylamino)-6-methyl-7-anilinofluoran, 3 (N-ethyl-N-cyclohexylamino)-6-methyl-7-(p-chloroanilino)fluoran, 3-(N-ethyl-p-toluidino)-6-methyl-7-anilinofluoran, 3-(N-ethyl-N-isoamylamino)-6-methyl-7-anilinofluoran, 3-(N-ethyl-N-isoamylamino)-6-chloro-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-ethyl-N-ethoxypropylamino)-6-methyl-7-anilinofluoran, 3-cyclohexylamino-6-chlorofluoran, 2-(4-oxahexyl)-3-dimethylamino-6-methyl-7-anilinofluoran, 2-(4-oxahexyl)-3-diethylamino-6-methyl-7-anilinofluoran, 2-(4-oxahexyl)-3-dipropylamino-6-methyl-7-anilinofluoran, 2-methyl-6-p-(p-dimethylaminophenyl)aminoanilinofluoran, 2-methoxy-6-p-(p-dimethylaminophenyl)aminoanilinofluoran, 2-chloro-3-methyl-6-p-(p-phenylaminophenyl)aminoanilinofluoran, 2-chloro-6-p-(p-dimethylaminophenyl)aminoanilinofluoran, 2-nitro-6-p-(p-diethylaminophenyl)aminoanilinofluoran, 2-amino-6-p-(p-diethylaminophenyl)aminoanilinofluoran, 2-diethylamino-6-p-(p-diethylaminophenyl)aminoanilinofluoran, 2-phenyl-6-methyl-6-p-(p-phenylaminophenyl)aminoanilinofluoran, 2-benzyl-6-p-(p-phenylaminophenyl)aminoanilinofluoran, 2-hydroxy-6-p-(p-phenylaminophenyl)aminoanilinofluoran, 3-methyl-6-p-(p-dimethylaminophenyl)aminoanilinofluoran, 3-diethylamino-6-p-(p-diethylaminophenyl)aminoanilinofluoran, 3-diethylamino-6-p-(p-dibutylaminophenyl)aminoanilinofluoran, 2,4-dimethyl-6-[(4-dimethylamino)anilino]-fluoran, <Fluorine Leucodye>

3,6,6'-tris(dimethylamino)spiro[fluorene-9,3'-phthalide]

3,6,6'-tris(diethylamino)spiro[fluorene-9,3'-phthalide]

<Divinyl Leucodye>

3,3-bis-[2-(p-dimethylaminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrrolidinophenyl)ethylen-2-yl]-4,5,6,7-tetrabromophthalide, 3,3-bis-[1-(4-methoxyphenyl)-1-(4-pyrrolidinophenyl)ethylen-2-yl]-4,5,6,7-tetrachlorophthalide, <Other Basic Dye>

3-(4-diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexylethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluoran-γ-(3'-nitro)anilinolactam, 3,6-bis(diethylamino)fluoran-γ-(4'-nitro)anilinolactam, 1,1-bis-[2',2',2",2"-tetrakis-(p-dimethylaminophenyl)-ethenyl]-2,2-dinitrileethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane, bis-[2,2,2',2'-tetrakis-(p-dimethylaminophenyl)-ethenyl]-methylmalonic acid dimethyl ester.

In thermal recording material of the present invention, the heat-coloring layer may contain a conventionally known sensitizer to the extent that the effect of the invention is not impaired (or within the range where the effect of the invention can be enhanced). As the sensitizer, for example, sensitizers known in the thermal recording material field may be used without limitation. For example, stearic acid amide, palmitic acid amide, methoxycarbonyl-N-stearic acid benzamide, N-benzoylstearic acid amide, N-eicosanoic acid amide, ethylenebisstearic acid amide, behenic acid amide, methylenebisstearic acid amide, methylolamide, N-methylol stearic acid amide, dibenzyl terephthalate, dimethyl terephthalate, dioctyl terephthalate, benzyl p-benzyloxybenzoate, phenyl 1-hydroxy-2-naphthoate, dibenzyl oxalate, di-p-methylbenzyl oxalate, oxalic acid-di-p-chlorobenzyl, 2-naphthylbenzyl ether, p-benzyl biphenyl, 4-biphenyl-p-tolyl ether, di(p-methoxyphenoxyethyl)ether, 1,2-di(3-methylphenoxy)ethane, 1,2-di(4-methylphenoxy)ethane, 1,2-di(4-methoxyphenoxy) ethane, 1,2-di(4-chlorophenoxy)ethane, 1,2-diphenoxyethane, 1-(4-methoxyphenoxy)-2-(2-methylphenoxy) ethane, p-methylthiophenylbenzyl ether, 1,4-di(phenylthio) butane, p-acetotoluidide, p-acetophenetidide, N-acetoacetyl-p-toluidine, di(β-biphenylethoxy)benzene, p-di (vinyloxyethoxy)benzene, 1-isopropylphenyl-2-phenylethane, 1,2-bis(phenoxymethyl)benzene, p-toluenesulfonamide, o-toluenesulfonamide, di-p-tolyl carbonate, phenyl-α-naphthyl carbonate, diphenylsulfone and the like can be mentioned. Of these, benzyl p-benzyloxybenzoate, di-p-methylbenzyl oxalate, 2-naphthylbenzyl ether, p-benzylbiphenyl, 4-biphenyl-p-tolyl ether, 1,2-di(3-methylphenoxy)ethane, 1,2-bis(phenoxymethyl)benzene and stearic acid amide are preferable. These sensitizers may be used alone or used in combination of two or more kinds thereof. The sensitizers are preferably used in an amount of about 0.1-5 parts by weight per 1 part by weight of the aforementioned condensate or condensed composition represented by the formula (I) (the first organic developer).

The thermal recording material of the present invention preferably contains a filler in the heat-coloring layer. As the filler, for example, inorganic or organic fillers such as silica, calcium carbonate, kaoline, calcined kaolin, diatomite, talc, titanium oxide, zinc oxide, aluminum hydroxide, polystyrene resin, urea-formalin resin, styrene-methacrylic acid copolymer, styrene-butadiene copolymer, hollow plastic pigment and the like, and the like can be mentioned. The filler is preferably contained in an amount of about 0.5-4 parts by weight per 1 part by weight of the aforementioned condensate or condensed composition (the first organic developer) represented by the formula (I).

Besides the above-mentioned sensitizers and fillers, stabilizers such as p-nitrobenzoic acid metal salt (Ca, Zn), benzyl monophthalate metal salt (Ca, Zn) and the like; parting agents such as fatty acid metal salt and the like; lubricants such as wax and the like; benzophenone or triazole ultraviolet absorbers; waterproof agents such as glyoxal resistance; dispersing agents; antifoaming agents and the like can be added as necessary.

While the production method of the thermal recording material of the present invention is not particularly limited, generally, it is obtained by dispersing the developer mixture of the present invention and a basic dye, and where necessary, additives such as a sensitizer etc. in a solution of a binder or an emulsion of a binder or a dispersion containing a binder in paste therein to give a coating liquid, and applying the resulting liquid to a support and drying the liquid to form a heat-coloring layer. The amount of the binder is suitably about 5-25 wt % relative to the total solid content of the heat-coloring layer.

Examples of the binder to be used in the invention include completely saponified polyvinyl alcohol having a polymerization degree of 200-1900, partially saponified polyvinyl alcohol, carboxy denatured polyvinyl alcohol, amide denatured polyvinyl alcohol, sulfonic acid denatured polyvinyl alcohol, butyral denatured polyvinyl alcohol, other denatured polyvinyl alcohols, hydroxyethyl cellulose, methyl cellulose, carboxymethyl cellulose, styrene-maleic anhydride copolymer, styrene-butadiene copolymer and cellulose derivatives such as ethyl cellulose and acetyl cellulose, polyvinyl chloride, polyvinyl acetate, polyacrylamide, polyacrylic acid ester, polyvinylbutyral polystyrol and copolymers thereof, polyamide resin, silicone resin, petroleum resin, terpene resin, ketone resin, cumarone resin and the like. These polymers can be used alone or in combination of two or more kinds thereof according to the requested quality. They may be dissolved in a solvent such as water, alcohol, ketone, ester, hydrocarbon and the like, or emulsified or dispersed in paste in water or other medium and used.

As the solvent to be used for the above-mentioned dispersion, for example, water, alcohols, ketones, esters, hydrocarbons and the like can be mentioned, with preference given to water.

When a thermal recording material is to be produced according to this method, the basic dye and the developer (the developer mixture of the present invention), and the additive to be added as necessary are preferably finely divided in a pulverizer such as ball mill, attritor, sand grinder and the like or a suitable emulsifying apparatus to a particle size of not more than several microns before use.

As a support on which to form a heat-coloring layer, paper, recycled paper, synthetic paper, plastic film, foamed plastic film, nonwoven fabric, metal foil and the like can be used, and a composite sheet combining these can also be used.

In the thermal recording material of the present invention, moreover, preservability can be enhanced by forming an overcoating layer made of a polymer containing an inorganic or organic filler, and the like on the heat-coloring layer. Moreover, preservability and sensitivity can be enhanced by forming an undercoating layer containing an organic and/or an inorganic filler under the heat-coloring layer.

EXAMPLES

The present invention is explained in detail in the following by referring to Examples and Reference Examples, which are not to be construed as limitative. In the following explanation, "parts" means "parts by weight".

The composition of the first organic developer (condensed composition represented by the formula (I)) was determined based on the analysis by high performance liquid chromatography (HPLC) under the following conditions, wherein the rate (area %) of each constituent component relative to the total area of the constituent components as 100 is shown, and other impurities are not included. In the following explanation, "%" means "area %".

column: Inertsil ODS-2
particle size: 5 μm
column: 4.6 mmϕ×15 cm
eluent: acetonitrile: 0.05 vol % aqueous phosphoric acid solution=98:2 (vol)
flow rate: 0.8 mL/min
wavelength: 280 nm
injection volume: 1.0 μL column temperature: 40° C.
analysis time: 25 min
sample density: about 2500 ppm (1) First Organic Developer The first organic developers used in the Examples and Comparative Examples below are as follows.

(a): Condensed Composition Containing 50% of 2,2'-methylenebis(4-t-butylphenol) (Condensed Composition (a))
[Composition]

2,2'-methylenebis(4-t-butylphenol): 2,6-bis(2-hydroxy-5-t-butylbenzyl)-4-t-butylphenol: 2,2'-methylenebis[6-[(2-hydroxy-5-t-butylphenyl)methyl]-4-t-butylphenol]: 2,6-bis[[2-hydroxy-3-[(2-hydroxy-5-t-butylphenyl)methyl]-5-t-butylphenyl]methyl]-4-t-butylphenol: 2,2'-methylenebis[6-[[2-hydroxy-3-[(2-hydroxy-5-t-butylphenyl)methyl]-5-t-butylphenyl]methyl]-4-t-butylphenol]: 2,6-bis[[2-hydroxy-3-[2-hydroxy-3-[(2-hydroxy-5-t-butylphenyl)methyl]-5-t-butylphenyl]methyl]-5-t-butylphenyl]methyl]-4-t-butylphenol=52:30:12:4:1.5:0.5

(b): Condensed Composition Containing 60% of 2,2'-methylenebis(4-t-butylphenol) (Condensed Composition (b))
[Composition]

2,2'-methylenebis(4-t-butylphenol): 2,6-bis(2-hydroxy-5-t-butylbenzyl)-4-t-butylphenol: 2,2'-methylenebis[6-[(2-hydroxy-5-t-butylphenyl)methyl]-4-t-butylphenol]: 2,6-bis[[2-hydroxy-3-[(2-hydroxy-5-t-butylphenyl)methyl]-5-t-butylphenyl]methyl]-4-t-butylphenol]: 2,2'-methylenebis[6-[[2-hydroxy-3-[(2-hydroxy-5-t-butylphenyl)methyl]-5-t-butylphenyl]methyl]-4-t-butylphenol]: 2,6-bis[[2-hydroxy-3-[2-hydroxy-3-[(2-hydroxy-5-t-butylphenyl)methyl]-5-t-butylphenyl]methyl]-5-t-butylphenyl]methyl]-4-t-butylphenol=63.2:26:8:2.2:0.5:0.1

(c): Condensed Composition Containing 70% of 2,2'-methylenebis(4-t-butylphenol) (Condensed Composition (c))
[Composition]

2,2'-methylenebis(4-t-butylphenol): 2,6-bis(2-hydroxy-5-t-butylbenzyl)-4-t-butylphenol: 2,2'-methylenebis[6-[(2-hydroxy-5-t-butylphenyl)methyl]-4-t-butylphenol]-71.7:27.1:1.2

(d): Condensed Composition Containing 60% of 2,2'-methylenebis(4-isopropylphenol) (Condensed Composition (d))
[Composition]

2,2'-methylenebis(4-isopropylphenol): 2,6-bis(2-hydroxy-5-isopropylbenzyl)-4-isopropylphenol: 2,2'-methylenebis[6-[(2-hydroxy-5-isopropylphenyl)methyl]-4-isopropylphenol]: 2,6-bis[[2-hydroxy-3-[(2-hydroxy-5-isopropylphenyl)methyl]-5-isopropylphenyl]methyl]-4-isopropylphenol: 2,2'-methylenebis[6-[[2-hydroxy-3-[(2-hydroxy-5-isopropylphenyl)methyl]-5-isopropylphenyl]methyl]-4-isopropylphenol]=60.1:35.2:3.7:0.8:0.2

(e): Condensed Composition Containing 80% of 2,2'-methylenebis(4-methylphenol) (Condensed Composition (e)).
[Composition]

2,2'-methylenebis(4-methylphenol): 2,6-bis(2-hydroxy-5-methylbenzyl)-4-methylphenol: 2,2'-methylenebis[6-[(2-hydroxy-5-methylphenyl)methyl]-4-methylphenol]=80.7:17.5:1.8

(2) The Developer Mixtures (Composition) Used in Examples and Comparative Examples Below are as Follows The developer mixtures A-I in Examples 1-8 and Comparative Example 6 were molten mixtures prepared by mixing two kinds of developer powders, heating the mixture to a temperature not less than the melting points of the two, mixing in a molten state and allowing the obtained molten product to cool.

[Developer Mixture A]

a developer mixture consisting of 98 parts of a condensed composition (the first organic developer) containing 50% of 2,2'-methylenebis(4-t-butylphenol) and 2 parts of 4-hydroxy-4'-isopropoxydiphenylsulfone (the second organic developer)

[Developer Mixture B]

a developer mixture consisting of 90 parts of a condensed composition (the first organic developer) containing 50% of 2,2'-methylenebis(4-t-butylphenol) and 10 parts of 4-hydroxy-4'-isopropoxydiphenylsulfone (the second organic developer)

[Developer Mixture C]

a developer mixture consisting of 80 parts of a condensed composition (the first organic developer) containing 50% of 2,2'-methylenebis(4-t-butylphenol) and 20 parts of 4-hydroxy-4'-isopropoxydiphenylsulfone (the second organic developer)

[Developer Mixture D]

a developer mixture consisting of 95 parts of a condensed composition (the first organic developer) containing 70% of 2,2'-methylenebis(4-t-butylphenol) and 5 parts of 4-hydroxy-4'-isopropoxydiphenylsulfone (the second organic developer)

[Developer Mixture E]

a developer mixture consisting of 95 parts of a condensed composition (the first organic developer) containing 50% of 2,2'-methylenebis(4-t-butylphenol) and 5 parts of benzyl p-hydroxybenzoate (BZ) (the second organic developer)

[Developer Mixture F]

a developer mixture consisting of 95 parts of a condensed composition (the first organic developer) containing 60% of 2,2'-methylenebis(4-isopropylphenol) and 5 parts of 4-hydroxy-4'-isopropoxydiphenylsulfone (the second organic developer)

[Developer Mixture G]

a developer mixture consisting of 95 parts of a condensed composition (the first organic developer) containing 80% of 2,2'-methylenebis(4-methylphenol) and 5 parts of 4-hydroxy-4'-isopropoxydiphenylsulfone (the second organic developer)

[Developer Mixture H]

a developer mixture consisting of 95 parts of benzyl p-hydroxybenzoate (BZ) (the second organic developer) and 5 parts of 4-hydroxy-4'-isopropoxydiphenylsulfone (the second organic developer)

(3) Examples

Example 1

| solution A (developer dispersion) | |
|---|---|
| developer mixture A | 6.0 parts |
| 10 wt % aqueous polyvinyl alcohol solution | 18.8 parts |
| water | 11.2 parts |
| solution B (sensitizer dispersion) | |
| benzyloxynaphthalene | 6.0 parts |
| 10 wt % aqueous polyvinyl alcohol solution | 18.8 parts |
| water | 11.2 parts |

-continued

| solution C (dye dispersion) | |
|---|---|
| 3-dibutylamino-6-methyl-7-anilinofluoran (ODB-2) | 2.0 parts |
| 10 wt % aqueous polyvinyl alcohol solution | 4.6 parts |
| water | 2.6 parts |

The above-mentioned solution A, solution B and solution C were each pulverized with a sand grinder until the developer, sensitizer and dye each had an average particle size of 1.0 micron, and they were mixed at the following ratio with kaolin clay (50 wt % dispersion) to give a coating liquid.

| | |
|---|---|
| solution A (developer dispersion) | 36.0 parts |
| solution B (sensitizer dispersion) | 36.0 parts |
| solution C (dye dispersion) | 9.2 parts |
| kaolin clay (50% dispersion) | 12.0 parts |

The above-mentioned coating liquid was applied to one side of a basic paper having a basic weight of 50 g/m$^2$ in a coating amount of 6.0 g/m$^2$ and dried at room temperature for 24 hr. This sheet was treated with a supercalender to smoothness of 500-600 sec to give a thermal recording material. The coated amount here means the amount of the solid adhered to the support after drying.

Example 2

A thermal recording material was produced in the same manner as in Example 1 except that solution A (developer dispersion) was prepared using developer composition B instead of developer mixture A.

Example 3

A thermal recording material was produced in the same manner as in Example 1 except that solution A (developer dispersion) was prepared using developer composition C instead of developer mixture A, and solution B (sensitizer dispersion) was prepared using oxalic acid bis(p-methylbenzyl) ester instead of benzyloxynaphthalene.

Example 4

A thermal recording material was produced in the same manner as in Example 1 except that solution A (developer dispersion) was prepared using developer composition D instead of developer mixture A, and solution B (sensitizer dispersion) was prepared using diphenylsulfone instead of benzyloxynaphthalene.

Example 5

A thermal recording material was produced in the same manner as in Example 1 except that solution A (developer dispersion) was prepared using developer composition E instead of developer mixture A and solution B (sensitizer dispersion) was prepared using 1,2-bisphenoxymethylbenzene instead of benzyloxynaphthalene.

Example 6

A thermal recording material was produced in the same manner as in Example 1 except that solution A (developer dispersion) was prepared using developer composition F instead of developer mixture A and solution B (sensitizer dispersion) was prepared using stearic acid amide instead of benzyloxynaphthalene.

Example 7

A thermal recording material was produced in the same manner as in Example 6 except that solution A (developer dispersion) was prepared using developer composition G instead of developer mixture F.

Comparative Example 1

A thermal recording material was produced in the same manner as in Example 1 except that solution A (developer dispersion) was prepared using condensed composition (condensed composition (a)) containing 50% of 2,2'-methylenebis(4-t-butylphenol) instead of developer mixture A.

Comparative Example 2

A thermal recording material was produced in the same manner as in Example 1 except that solution A (developer dispersion) was prepared using condensed composition (condensed composition (b)) containing 60% of 2,2'-methylenebis(4-t-butylphenol) instead of developer mixture A.

Comparative Example 3

A thermal recording material was produced in the same manner as in Example 1 except that solution A (developer dispersion) was prepared using condensed composition (condensed composition (c)) containing 70% of 2,2'-methylenebis(4-t-butylphenol) instead of developer mixture A.

Comparative Example 4

A thermal recording material was produced in the same manner as in Comparative Example 1 except that solution A (developer dispersion) was prepared using condensed composition (condensed composition (d)) containing 60% of 2,2'-methylenebis(4-isopropylphenol) instead of (condensed composition (a)) containing 50% of 2,2'-methylenebis(4-t-butylphenol), and solution B (sensitizer dispersion) was prepared using stearic acid amide instead of benzyloxynaphthalene.

Comparative Example 5

A thermal recording material was produced in the same manner as in Comparative Example 4 except that solution A (developer dispersion) was prepared using condensed composition (condensed composition (e)) containing 80% of 2,2'-methylenebis(4-methylphenol) instead of condensed composition (condensed composition (d)) containing 80% of 2,2'-methylenebis(4-isopropylphenol).

Comparative Example 6

A thermal recording material was produced in the same manner as in Example 1 except that solution A (developer dispersion) was prepared using developer mixture H instead of developer mixture A, and solution B (sensitizer dispersion) was prepared using 1,2-bisphenoxymethylbenzene instead of benzyloxynaphthalene.

The thermal recording materials produced in the above Examples and Comparative Examples were tested for the following quality and performance. The results are shown in Table 1. In the Tables, the numerals in the upper line show the density of the recorded area and those in the lower line show the density of the non-image area.

[Thermal Recordability Test (Color Sensitivity Test)]

The prepared thermal recording materials were subjected to printing using TH-PMD manufactured by Ohkura Electric Co., Ltd. (thermal printer, equipped with a thermal head manufactured by Kyocera Corporation) at an impression energy of 0.38 mj/dot. The image density of the recorded area and the density of the non-recorded area were measured with the Macbeth densitometer (RD-914, using Amber Filter).

[Heat Resistance Test]

The thermal recording materials printed on in the thermal recordability test were stood for 24 hr in a dry environment at a test temperature of 60° C., and the image densities of the recorded area and the non-image area were measured with the Macbeth densitometer.

[Moisture Resistance Test]

The thermal recording materials printed on in the thermal recordability test were stood for 24 hr in an environment of a test temperature 40° C. and 90% RH, and the image densities of the recorded area and the non-image area were measured with the Macbeth densitometer.

As is clear from Table 1, the thermal recording materials (thermal recording materials of Examples 1-7) obtained using developer mixtures A-G, wherein two kinds of developers of the present invention are mixed, show high color sensitivity, afford recorded images having high color density, are free of coloring of non-image areas and show good preservation stability (particularly heat resistance of recorded images), as compared to thermal recording materials of Comparative Examples 1-5 using one kind of developer. In addition, it is also clear that the thermal recording materials (thermal recording materials of Examples 1-7) of the present invention which are obtained using developer mixtures A-G wherein two kinds of developers are mixed show markedly low coloring in the non-image areas in a heat resistance test, as compared to Comparative Example 6 not using an organic developer (the first organic developer) comprising a condensed composition of the formula (I) but using developer mixture H wherein known two kinds of organic developers other than such developer are used.

INDUSTRIALLY APPLICABILITY

According to the present invention, a thermal recording material which has extremely high color sensitivity, affords

TABLE 1

| | developer | sensitizer | | dynamic color density | heat resistance | moisture resistance |
|---|---|---|---|---|---|---|
| Ex. 1 | developer mixture A | benzyloxynaphthalene | recorded areas | 1.41 | 1.25 | 1.34 |
| | | | non-image areas | 0.07 | 0.10 | 0.08 |
| Ex. 2 | developer mixture B | benzyloxynaphthalene | recorded areas | 1.43 | 1.31 | 1.37 |
| | | | non-image areas | 0.07 | 0.14 | 0.10 |
| Ex. 3 | developer mixture C | oxalic acid bis(p-methyl-benzyl) ester | recorded areas | 1.46 | 1.38 | 1.42 |
| | | | non-image areas | 0.07 | 0.15 | 0.10 |
| Ex. 4 | developer mixture D | diphenylsulfone | recorded areas | 1.40 | 1.08 | 1.29 |
| | | | non-image areas | 0.09 | 0.13 | 0.09 |
| Ex. 5 | developer mixture E | 1,2-bisphenoxy-methyl-benzene | recorded areas | 1.42 | 1.14 | 1.36 |
| | | | non-image areas | 0.09 | 0.12 | 0.09 |
| Ex. 6 | developer mixture F | stearic acid amide | recorded areas | 1.31 | 1.18 | 1.22 |
| | | | non-image areas | 0.08 | 0.10 | 0.09 |
| Ex. 7 | developer mixture G | stearic acid amide | recorded areas | 1.44 | 1.06 | 1.34 |
| | | | non-image areas | 0.09 | 0.10 | 0.10 |
| Comp. Ex. 1 | condensed composition (a) | benzyloxynaphthalene | recorded areas | 1.31 | 0.94 | 1.23 |
| | | | non-image areas | 0.07 | 0.06 | 0.06 |
| Comp. Ex. 2 | condensed composition (b) | benzyloxynaphthalene | recorded areas | 1.30 | 0.85 | 1.20 |
| | | | non-image areas | 0.07 | 0.07 | 0.06 |
| Comp. Ex. 3 | condensed composition (c) | benzyloxynaphthalene | recorded areas | 1.31 | 0.79 | 1.18 |
| | | | non-image areas | 0.07 | 0.07 | 0.06 |
| Comp. Ex. 4 | condensed composition (d) | stearic acid amide | recorded areas | 1.18 | 0.90 | 1.01 |
| | | | non-image areas | 0.07 | 0.11 | 0.09 |
| Comp. Ex. 5 | condensed composition (e) | stearic acid amide | recorded areas | 1.31 | 0.93 | 1.09 |
| | | | non-image areas | 0.09 | 0.10 | 0.09 |
| Comp. Ex. 6 | developer mixture H | 1,2-bis-phenoxy-methyl-benzene | recorded areas | 1.39 | 0.80 | 0.91 |
| | | | non-image areas | 0.09 | 0.41 | 0.08 |

high density and clear color images, is capable of suppressing coloring of non-image areas experienced when conventional, two or more kinds of developers are used in combination, and is superior in preservation stability (particularly heat resistance, moisture resistance) of color images and non-image areas can be obtained.

This application is based on a patent application No. 2004-069771 filed in Japan, the contents of which are incorporated in full herein by this reference.

The invention claimed is:

1. A thermal recording material comprising a support and a heat-coloring layer containing a sensitizer which is at least one member selected from the group consisting of benzyl p-benzyloxybenzoate, di-p-methylbenzyl oxalate, 2-naphthylbenzyl ether, p-benzylbiphenyl, 4-biphenyl-p-tolyl ether, 1,2-di(3-methylphenoxy)ethane, 1,2-bis(phenoxymethyl) benzene and stearic acid amide formed thereon, which layer comprises a colorless or pale basic dye and a developer mixture for a thermal recording material as main components, which developer mixture comprises a mixture of a first organic developer which is a condensed composition mainly comprising a condensate represented by the formula (I):

(I)

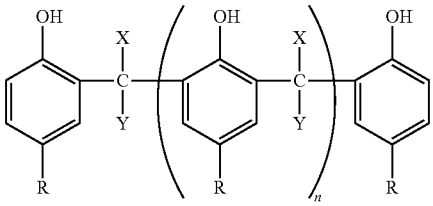

wherein R is a tert-butyl group, X and Y are each a hydrogen atom, and n=0 (2 core condensate), and further comprising at least one kind of condensate selected from condensates of the formula (I) wherein n=1-5 (3-7 core condensates), and a second organic developer other than the first organic developer which is not 2,2-bis(3-methyl-4-hydroxyphenyl)propane, wherein the second organic developer is at least one member selected from the group consisting of 4-hydroxy-4'-isopropoxydiphenylsulfone; 4-hydroxy-4'-propoxydiphenylsulfone; benzyl p-hydroxybenzoate; bis(3-allyl-4-hydroxyphenyl)sulfone; a composition comprising 2,2'-bis[4-(4-hydroxyphenylsulfone)phenoxy]diphenylether; 2,4-bisphenolsulfone; and 4,4-bisphenolsulfone, the content of the condensate of the formula (I) wherein n=0 (2 core condensate) in the condensed composition, which is the first organic developer, is 40-90%, and the first and the second organic developers are mixed at a mixing ratio (the first organic developer: the second organic developer) of 99.9:0.1-70:30 (weight ratio).

2. The thermal recording material of claim 1, wherein the developer mixture is obtained by dissolution mixing or melt mixing the first and the second organic developers.

3. The thermal recording material of claim 1, wherein the content of an organic developer in the heat-coloring layer is 1-8 parts by weight per 1 part by weight of the basic dye.

4. The thermal recording material of claim 1, wherein the second organic developer is at least one member selected from the group consisting of 4-hydroxy-4'-isopropoxydiphenylsulfone, 4-hydroxy-4'-propoxydiphenylsulfone and benzyl p-hydroxybenzoate.

5. The thermal recording material of claim 1, wherein the content of the sensitizer in the heat-coloring layer is 0.1-5 parts by weight per 1 part by weight of the condensed composition.

* * * * *